US005668561A

United States Patent [19]

Perrotta et al.

[11] Patent Number: 5,668,561

[45] Date of Patent: Sep. 16, 1997

[54] ANTENNA COUPLER

[75] Inventors: Alessandro Perrotta, Ft. Lauderdale; David H. Minasi, Plantation, both of Fla.

[73] Assignee: Motorola, Inc., Schaumburg, Ill.

[21] Appl. No.: 556,696

[22] Filed: Nov. 13, 1995

[51] Int. Cl.[6] ..... H01Q 1/24

[52] U.S. Cl. ..... 343/702; 343/841; 343/906

[58] Field of Search ..... 343/702, 841, 343/872, 905, 906, 895; 455/89, 90; H01Q 1/24, 1/50

[56] References Cited

U.S. PATENT DOCUMENTS

D. 354,961 1/1995 Richards et al. ..... D14/253
4,661,992 4/1987 Garay et al. ..... 455/89
4,740,794 4/1988 Phillips ..... 343/702
5,469,177 11/1995 Rush et al. ..... 343/895
5,557,287 9/1996 Pottala et al. ..... 343/702

*Primary Examiner*—Hoanganh T. Le
*Attorney, Agent, or Firm*—Barbara R. Doutre

[57] ABSTRACT

An antenna coupler (100) for use in a mobile adaptor (102, 300) transfers radio frequency (RF) energy between a portable radio antenna system (204) and an external antenna (124) with minimal coupling losses. The antenna coupler (100) includes a resonator patch (110) and an electromagnetic tuning element (112) forming side walls on a substrate for receiving the portable antenna system (204). The electromagnetic tuning element (112) controls the impedance between the resonator patch (110) and the portable antenna system (204) while the resonator patch transfers the RF energy between the portable radio antenna and the external antenna (124).

21 Claims, 3 Drawing Sheets

ANTENNA COUPLER

TECHNICAL FIELD

This invention relates in general to antenna couplers and more specifically to antenna couplers for use in mobile adapters.

BACKGROUND

In recent years there has been a growing interest in portable radios, such as two-way radios and cellular telephones. Often a portable radio user will have a need for radio communication while in a vehicle. The portable radio, when located inside the vehicle may not perform satisfactorily over long distances because either the portable antenna is insufficient or the vehicle body shields the portable antenna. Thus, the user must either purchase a separate mobile unit or use the portable radio with an external antenna through a mobile adapter.

Coupling losses associated with inserting the portable radio into the mobile adapter are a major concern in the design of any mobile adapter. Conventional methods of connecting a portable radio antenna to an external antenna often require a changeover switch which functions to disconnect or connect the internal and external antennas such that the two antennas are not connected at the same time. Switching between the two antennas, however, has a tendency to degrade the efficiency of the system. It would be an advantage to have an antenna coupler which minimizes the loses associated with inserting the portable radio into the mobile adapter.

Another disadvantage associated with many mobile adapters is that some form of power amplification, commonly known as a power "booster", is required to compensate for the coupling losses incurred when the portable radio is inserted into the mobile adapter. An antenna coupler configured to eliminate the need for additional power amplification would be a further advantage in terms of manufacturing costs and parts count.

Also, many of today's mobile adapters still require both a radio frequency (RF) contact and a ground contact on the exterior of the mobile adapter's housing in order to make the RF interconnection to the portable radio. This requires that the portable radio have at least two exposed contacts which must align within the mobile adapter housing. It would be beneficial if the number of exposed contacts could be reduced in order to ease alignment issues and reduce the exposure of radio contacts to the external environment when the portable radio is not in the adapter. A mobile adapter that included an antenna coupler which required as few interface contacts as possible would translate to fewer exposed contacts on the radio.

Accordingly, there exists a need to provide an improved antenna coupler for use in a mobile adapter which minimizes RF coupling losses using as few interface contacts as possible while eliminating the need for any additional power amplification.

DETAILED DESCRIPTION OF THE PREFERRED EMBODIMENT

Figure 1:
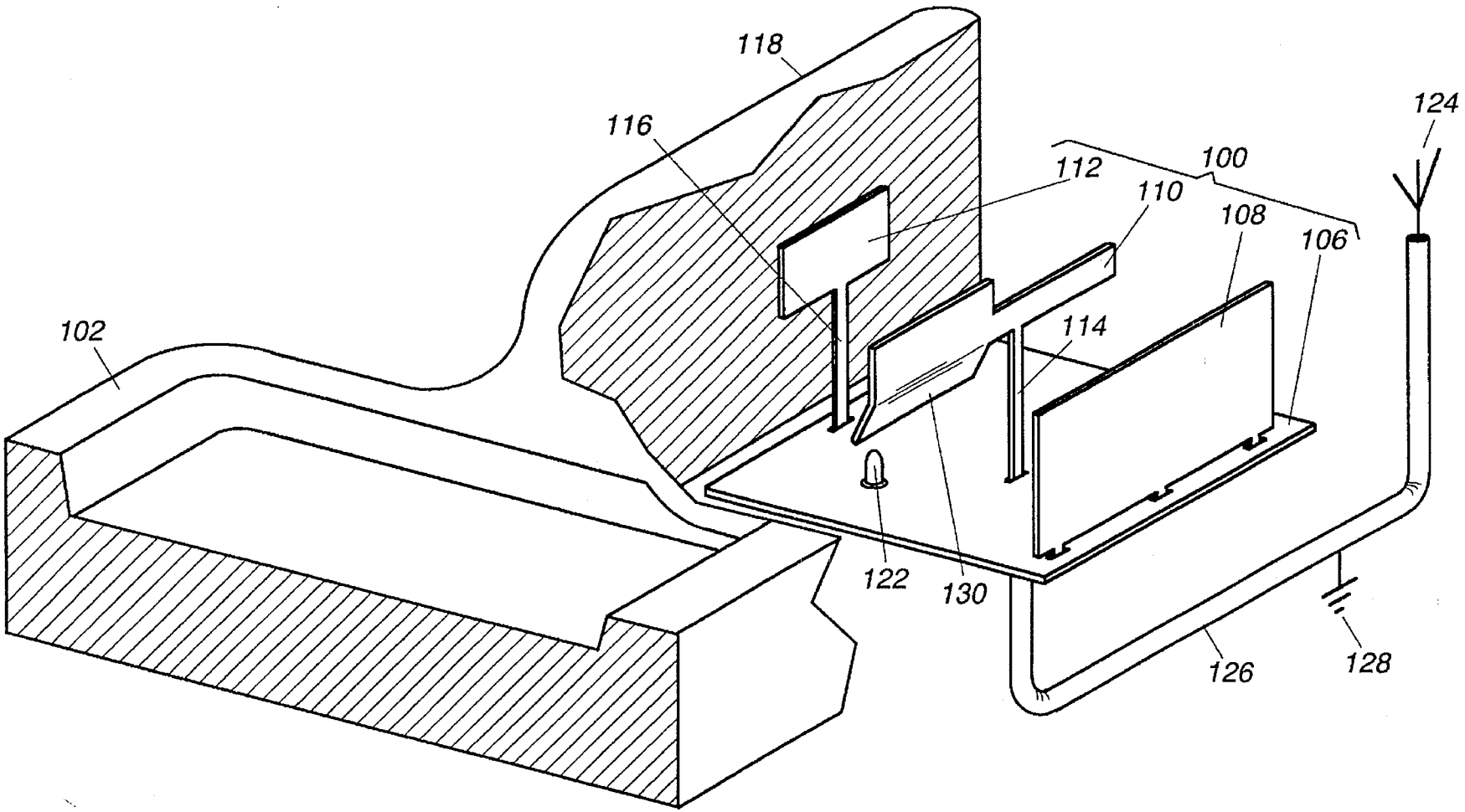
FIG. 1 shows an antenna coupler in accordance with the present invention.
Figure 2:
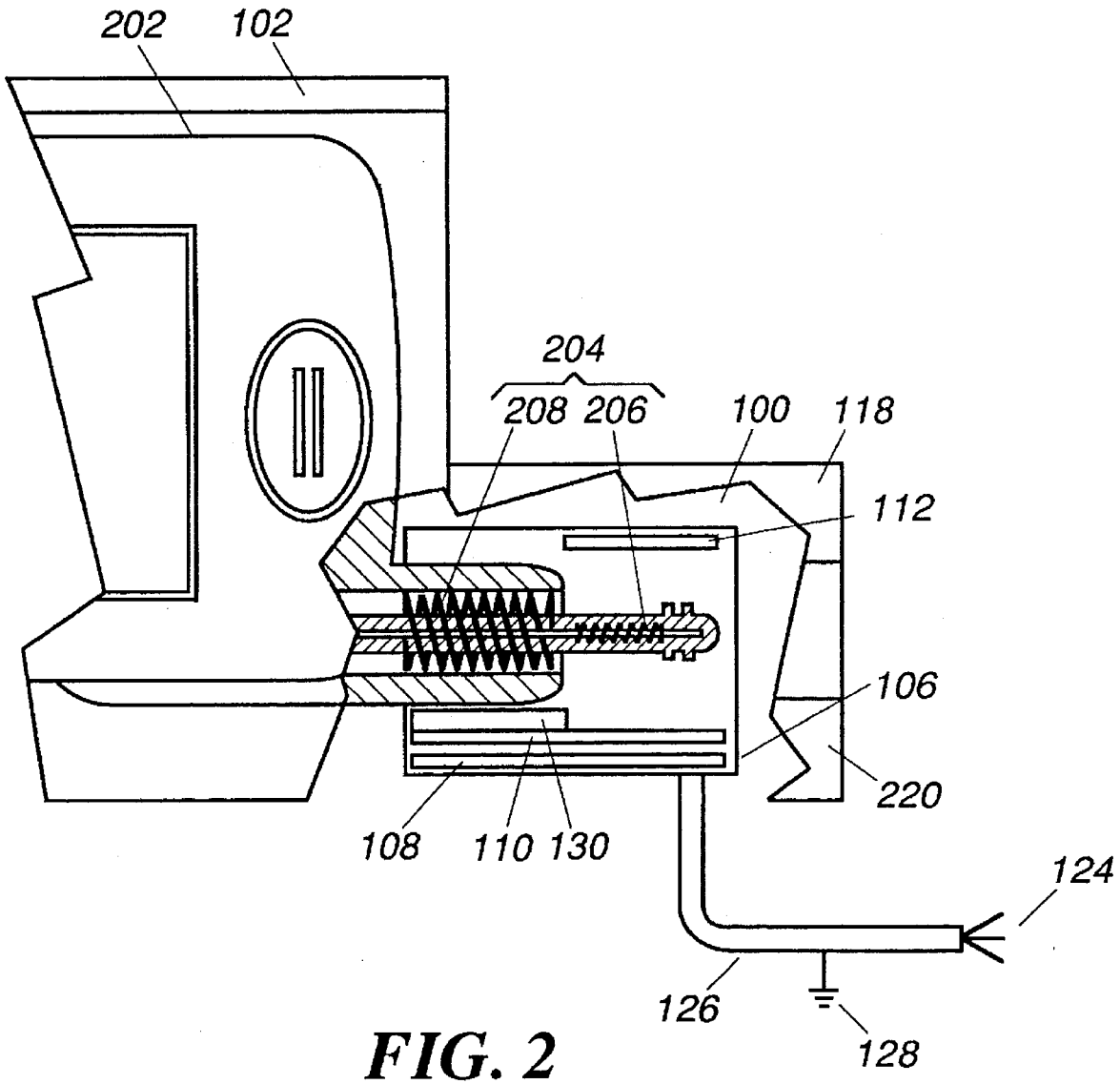
FIG. 2 shows a top view of the antenna coupler of FIG. 1 receiving an antenna system of a portable radio in accordance with the present invention.

Referring now to FIG. 1 of the accompanying drawings, there is shown an antenna coupler 100 in accordance with the present invention. The antenna coupler 100 allows a portable radio having an attached antenna system to couple to an external antenna 124. FIG. 2 shows a top view of the antenna coupler of FIG. 1 in conjunction with a partially viewed portable radio 202 having an attached antenna system 204. FIGS. 1 and 2 will be used to describe the antenna coupler 100 in its' preferred embodiment. The antenna coupler 100 is included within a housing 102, such as a mobile adapter housing, which is shaped to receive the portable radio 202 having the attached antenna system 204. The attached antenna system 204 includes at least one radiator element 206 with which to transmit and receive radio frequency (RF) signals, and in the preferred embodiment, includes a second radiator element 208. In accordance with the invention, the antenna coupler 100 includes a substrate 106, such as a printed circuit board, a shield 108, a resonator patch 110, and a electromagnetic tuning element 112 formed in a manner to be described herein.

The substrate 106 and the external antenna 124 are connected through an RF feed 126, preferably a 50 ohm coaxial cable. The resonator patch 110 electrically couples to the RF feed 126 through a conductive feed 114 formed as an extension of the resonator patch. The resonator patch 110 forms a first side wall for transferring an RF signal to and from the antenna system 204. The conductive shield 108 couples to a ground plane of the substrate 106 to form a second side wall substantially parallel to the resonator patch 110 to inhibit radiation therefrom. The electromagnetic tuning element 112 is connected to the substrate 106 through a grounded feed 116 and provides a third side wall in a plane substantially parallel to the resonator patch 110. The electromagnetic tuning element 112 is enclosed within a retaining wall 118 of housing 102 while the resonator patch 110 and shield 108 are enclosed within a second similar retaining wall 220 (partially shown in FIG. 2). Retaining walls 118, 220 form a cradle within housing 102 with which to receive the antenna system 204 of the portable radio 202. The retaining walls 118, 220 provide alignment of the antenna system 204 within the antenna coupler 100. A single ground contact 122, preferably a grounded pogo pin, mates the antenna coupler's substrate 106 to a corresponding ground contact (not shown) of the portable radio 202.

In accordance with the present invention, the electromagnetic tuning element 112 is dimensioned and disposed onto the substrate 106 such that the tuning element aligns substantially in parallel with a predetermined portion of the antenna system 204 when the antenna system is received by the housing 102. In accordance with the invention, the electromagnetic tuning element 112 is responsible for controlling an impedance seen between the attached antenna system 204 and the resonator patch 110. The impedance is controlled by varying the dimensions of the electromagnetic tuning element 112. The height (or length) of the grounded feed 116 allows the tuning element 112 to be positioned substantially parallel to the antenna system 204 at a distance determined to provide capacitive coupling between the electromagnetic tuning element and a predetermined portion of the antenna system 204. The electromagnetic tuning element 112 and the ground feed 116 extending therefrom are preferably formed of conductive metal, such as copper sheet metal, and are preferably coupled to the substrate 106 using conventional soldering techniques.

In accordance with the present invention, the resonator patch 110 is dimensioned and disposed onto the substrate 106 such that the resonator patch aligns substantially in parallel with the antenna system 204 when received by the housing 102. In accordance with the invention, the resonator patch 110 is responsible for transferring RF energy between the radio's attached antenna system 204 and the external antenna 124. The height (or length) of the conductive feed 114 allows the resonator patch 110 to be positioned substantially parallel to the antenna system 204 at a distance determined to provide capacitive coupling between the resonator patch 110 and the antenna system 204. The resonator patch 110 and the conductive feed 114 extending therefrom, are preferably formed of conductive metal, such as copper sheet metal, and are preferably coupled to the substrate 106 using conventional soldering techniques.

Thus, the resonator patch 110 and electromagnetic tuning element 112 capacitively couple to the antenna system 204 to transfer RF energy to and from the external antenna 124 without having to switch between antennas. Dimensioning the resonator patch 110 for optimum energy transfer and dimensioning the electromagnetic tuning element 112 for optimum impedance provides for low loss coupling of the antenna coupler 100 in accordance with the present invention. Coupling losses associated with the antenna coupler 100 described by the present invention have measured in the approximate range of −2.5 to −3 decibels (dB), a significant improvement over the typical coupling losses of −6 dB associated with prior art energy transfer techniques. The antenna coupler 100 described by the invention also eliminates the need for any external RF contacts on either the antenna coupler or the portable radio.

The attached antenna system 204 is preferably a retractable antenna system which includes first and second radiator elements 206, 208 inductively and capacitively coupled together in the retracted position. The first (or top) radiator element 206 is preferably a quarter wave coil which can be extended via a rod (not shown), when the portable radio 202 is used in a hand-held position and retracted for use in a mobile position. In the preferred embodiment of the invention, the electromagnetic tuning element 112 is dimensioned or sized to approximate the parallel cross sectional area of top coil 206 in a plane perpendicular to the substrate 106. The height and location of ground feed 116 on the substrate 106 is positioned such that the electromagnetic tuning element 112 capacitively couples to the top coil 206.

The second radiator element 208 is preferably a quarter wave base coil which resides in the upper portion of the portable radio 202. In the preferred embodiment of the invention, the resonator patch 110 is dimensioned or sized to approximate the shape of the parallel cross sectional area of the top coil 206 and the base coil 208 in the retracted position in a plane perpendicular to the substrate 106. The height and location of the conductive feed 114 is positioned on the substrate 106 such that capacitive coupling occurs between the resonator patch 110 and the antenna system 204. The resonator patch 110 is preferably further shaped to include a flange portion 130 to contour a portion of the base coil 208. By contouring the flange portion 130 about the base coil 208 further improvements in coupling are incurred.

FIG. 2 shows the antenna system 204 cradled between the retaining walls 118, 220 and coupled within the side walls formed by the resonator patch 110 and electromagnetic tuning element 112. Thus, RF energy can be transferred to and from the antenna system 204 via the resonator patch 110 using both top and base coils (206, 208) while the impedance is controlled by the coupling occurring between the top coil 206 and the electromagnetic tuning element 112.

In operation, when the portable radio 202 is inserted into the housing 102, the antenna system 204 becomes cradled between the resonator patch 110 and the electromagnetic tuning element 112. Signals received or transmitted though portable radio antenna system 204 are transferred via capacitive coupling to or from the resonator patch 110. The electromagnetic tuning element 112 and the resonator patch 110 receive the retractable antenna system 204 such that the top coil 206 electrically couples to the electromagnetic tuning element 112 and the combination of the base coil 208 and top coil 206 electrically couple to the resonator patch 110. Ground contact is achieved through the use of the single contact pin 122 extending from the ground of the substrate 106 to a corresponding mating ground contact of the portable radio antenna system 204. The radiator patch 110 capacitively couples to the antenna system 204 to allow for the transfer of RF energy. The RF shield 108 prevents the resonator patch 110 from radiating RF energy outside of the mobile adapter housing 102. The resonator patch 110 transfers energy to and from the external antenna 124 via the RF feed 126, preferably the coaxial cable. The coaxial cable 126 is terminated at the external antenna 124 using conventional hardware (not shown). The outer conductor of the coaxial cable 126 is coupled to ground 128.

Hence, in accordance with the present invention, dimensioning the electromagnetic tuning element 112 controls the impedance between the retractable antenna system 204 and the resonator patch 110. Dimensioning of the resonator patch 110 to conform to the approximate shape of the parallel cross sectional area of the base coil 208 and top coil 206 in the retracted position provides improved coupling for the transfer of RF energy. Thus, coupling losses are minimized and an optimum energy transfer can occur without the use of any external RF contacts or any additional power amplifier circuits.

The substrate 106 may also contain a matching network (not shown). This network is used to match the impedance of the external antenna 124 to the impedance at the resonator patch 110. Improved matching helps decrease the potential of undesirable standing waves. If an impedance matching network is necessary, this circuit can be disposed on the substrate, preferably at the input to the RF feed 126 and thus has no impact on portable radio performance when the portable 202 is removed from the mobile adapter housing 102. The radio frequency impedance of the ground connection between the portable radio ground contact and the ground of substrate 106 may be reduced by adding a capacitive reactance in series with the contact pin 122, preferably through a grounded capacitor component (not shown) on the bottom of the substrate 106.

Figure 3:
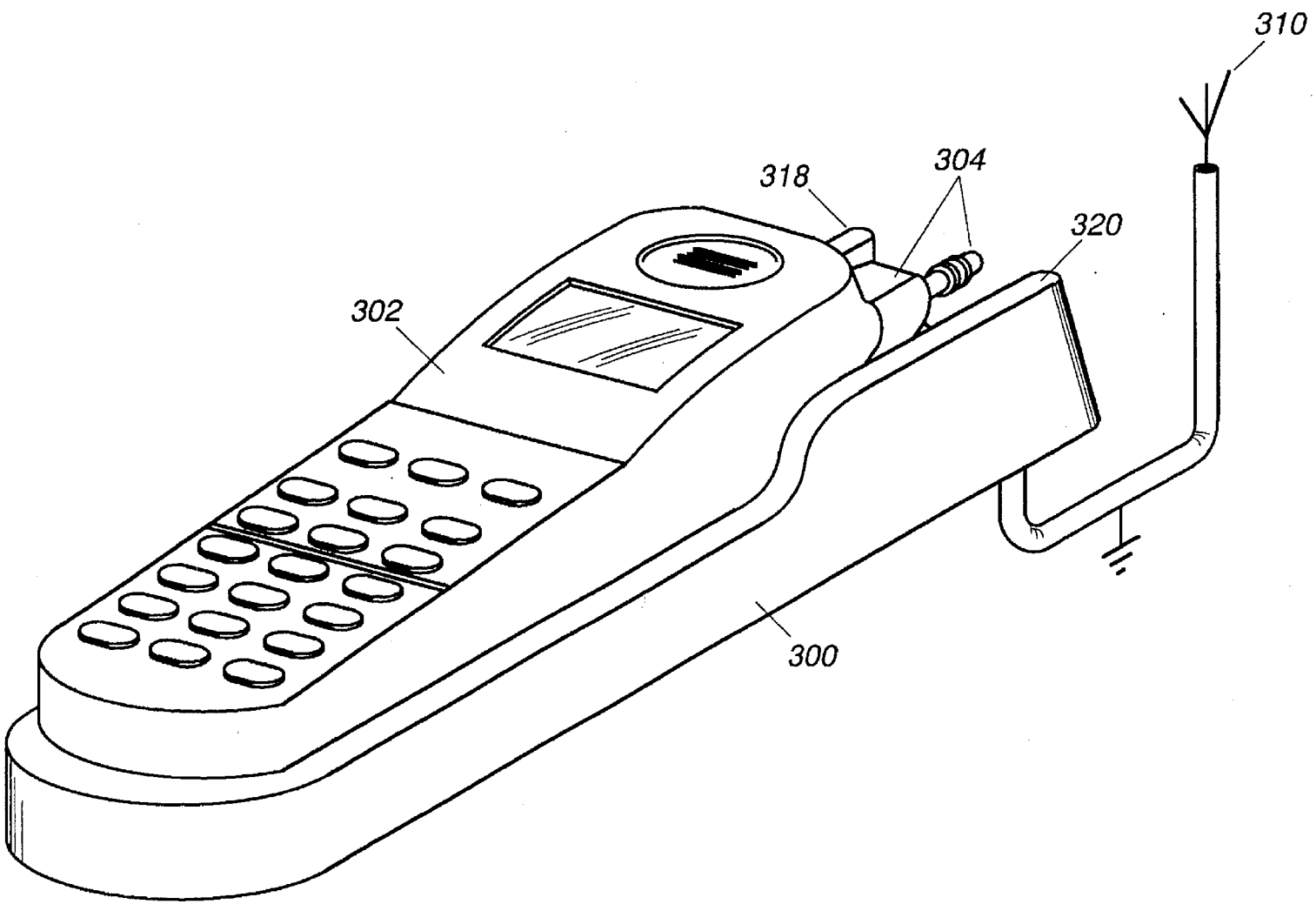
FIG. 3 shows a mobile adapter including and antenna coupler in accordance with the present invention.

Referring now to FIG. 3, there is shown an illustration of a mobile adapter housing 300 formed in accordance with the invention and adapted to receive a portable radio 302 having an attached antenna 304 including at least one radiator element. The mobile adapter 300 includes an antenna coupler formed within retaining walls 318, 320 in accordance with the invention. When the attached antenna system 304 of radio 302 is received within retaining walls 318, 320 of the mobile adapter housing 300, the internal antenna coupler transfers RF energy to and from an external antenna 310 in the manner previously described. The external antenna 310 may be mounted on the roof of the mobile vehicle and connected to the housing 300 and the antenna coupler by way of a coaxial cable 312 connected therebetween. The impedance the coaxial cable 312 is dictated by the impedance of the external antenna 310. Typically, an external antenna 310 used in a mobile unit will be a conventionally available vertical omni-directional whip antenna with an impedance of 50 ohms. The attached antenna 304 of the radio 302 is used in conjunction with the internal antenna coupler described by the invention and the external antenna 310 without the need to switch any antenna off and without any RF interface contacts between the radio and the adapter. Because the majority of the RF energy is now transferred to and from a resonator patch, coupling losses are minimized and the need for any additional power amplification is eliminated. Thus, the antenna coupler described by the invention provides a low loss, efficient, and inexpensive solution to providing mobility to the portable radio user.

While the preferred embodiment describes and illustrates an antenna system having at least one radiator element and preferably two radiator elements, one skilled in the art realizes that the antenna coupler described by the invention can apply to antenna systems having multiple radiator elements or a single radiator element. Optimizing the impedance seen between the resonator patch and the antenna system by dimensioning the tuning element and maximizing the energy transfer between the antenna system and the resonator patch by dimensioning the resonator patch provides for a low loss antenna coupler which minimizes coupling losses without the use of RF interconnects or power amplification.

While the preferred embodiments of the invention have been illustrated and described, it will be clear that the invention is not so limited. Numerous modifications, changes, variations, substitutions, and equivalents will occur to those skilled in the art without departing from the spirit and scope of the present invention as defined by the appended claims.

What is claimed is:

1. An antenna coupler for coupling a portable radio having an attached antenna system to an external antenna, the attached antenna system including at least one radiator element, the antenna coupler comprising:

a substrate;

a radio frequency (RF) feed connected from the external antenna to the substrate;

a resonator patch electrically coupled to the RF feed on the substrate, said resonator patch dimensioned to substantially conform to a cross sectional area of the at least one radiator element;

a conductive shield connected to the substrate forming a side wall substantially parallel to the resonator patch, the conductive shield inhibiting radiation of the resonator patch;

an electromagnetic tuning element connected to the substrate through a grounded feed portion, the electromagnetic tuning element forming a second side wall substantially parallel to the resonator patch, said resonator patch and said second side wall receiving a portion of the portable radio including the at least one radiator element, said electromagnetic tuning element dimensioned to provide an optimum impedance between the attached antenna system and the resonator patch; and wherein the antenna coupler is non-pivotal.

2. An antenna coupler as described in claim 1, wherein the electromagnetic tuning element is capacitively coupled to the at least one radiator element.

3. An antenna coupler as described in claim 1, wherein the resonator patch includes a flange extending therefrom, said flange disposed about a predetermined portion of the attached antenna system.

4. An antenna coupler as described in claim 1, wherein the RF feed comprises a 50 ohm coaxial cable.

5. An antenna coupler as described in claim 1, wherein the resonator patch is electrically coupled to the RF feed through a conductive feed extending from the resonator patch.

6. An antenna coupler as described in claim 1, further comprising:

a ground pin located on the substrate for mating with a corresponding ground contact of the portable radio.

7. An antenna coupler as described in claim 1, wherein the substrate comprises a printed circuit board.

8. An antenna coupler as described in claim 1, further comprising a flange portion extending from the resonator patch and forming a contoured portion about a portion of the attached antenna system.

9. A non-pivotal antenna coupler for coupling a portable radio having a retractable antenna system to an external antenna, the retractable antenna system including a base coil located within a portion of the portable radio and a retracted coil, said antenna coupler comprising:

a substrate;

a radio frequency (RF) feed coupled between the external antenna and the substrate;

a resonator patch electrically coupled to the RF feed on the substrate;

a conductive shield coupled to the substrate and located substantially parallel to the resonator patch, the conductive shield inhibiting radiation of the resonator patch; and an electromagnetic tuning element coupled to the substrate through a grounded feed portion and located substantially parallel to the resonator patch, the electromagnetic tuning element and the resonator patch receive the retractable antenna system such that the base coil electrically couples to the electromagnetic tuning element and the base coil and retracted coil electrically couple to the resonator patch, the electromagnetic tuning element dimensioned to provide an optimum impedance between the retractable antenna system and the resonator patch.

10. A non-pivotal antenna coupler as described in claim 9, wherein said resonator patch is dimensioned to substantially conform to a cross sectional area of said base coil and said retracted coil.

11. A non-pivotal antenna coupler as described in claim 9, wherein said resonator patch includes flange portion extending therefrom, said flange portion contoured about a portion of the base coil.

12. A method of forming a non-pivotal antenna coupler for improving the impedance match between a portable radio having an attached antenna system and an external antenna, said attached antenna system including at least one radiator element, the method comprising the steps of:

electrically coupling a radio frequency (RF) signal between the at least one radiator element and a first side of a resonator patch having first and second sides;

electrically coupling an electromagnetic tuning element to the at least one radiator element;

shielding the second side of the resonator patch; and sizing the electromagnetic tuning element to control the impedance match between the portable radio antenna and the resonator patch.

13. A method as described in claim 12, wherein the step of electrically coupling RF signal further includes the step of optimizing the electrical coupling by dimensioning the resonator patch to approximate a parallel cross sectional area of the attached antenna system including the at least one radiator element.

14. A mobile adapter for adapting a portable radio antenna to an external antenna, comprising:

a housing;

a radio frequency (RF) feed connected to the external antenna for receiving and transmitting RF energy;

a non-pivotal antenna coupler located within the housing, including:

a printed circuit board coupled to the RF feed and including a ground plane;

a resonator patch coupled to the printed circuit board and RF feed for transferring RF energy to and from the external antenna; and an electromagnetic tuning element coupled to the ground plane of the printed circuit board, said electromagnetic tuning element and resonator patch forming side walls within which to receive the portable radio antenna, said side walls capacitively couple to predetermined portions of the portable radio antenna, said electromagnetic tuning element controlling an impedance seen between the portable radio antenna and the resonator patch.

15. A mobile adapter as described in claim 14, further comprising a ground contact located on the housing and electrically coupled to the ground plane of the printed circuit board, said ground contact for connecting to a corresponding ground contact located on the portable radio antenna.

16. A mobile adapter as described in claim 15, wherein the ground contact on the printed circuit board is capacitively coupled to the ground plane.

17. A mobile adapter as described in claim 14, further comprising a shield coupled to the printed circuit board in a plane parallel to the resonator patch for inhibiting radiation of RF energy beyond the housing.

18. A mobile adapter as described in claim 17, wherein the portable radio antenna includes first and second radiator elements inductively coupled therebetween, the electromagnetic tuning element being dimensioned to approximate a parallel cross sectional area of the first radiator element in a plane perpendicular to the printed circuit board, and the resonator patch being dimensioned to approximate a cross sectional area of the first and second radiator elements in a plane perpendicular to the printed circuit board.

19. A mobile adapter as described in claim 18, wherein the resonator patch further comprises a flange portion extending from the resonator patch and contouring a predetermined portion of the portable radio antenna.

20. A mobile adapter as described in claim 14, wherein said electromagnetic tuning element is dimensioned to approximate a predetermined portion of the portable radio antenna.

21. A mobile adapter as described in claim 20, wherein the resonator patch is dimensioned to approximate a predetermined portion of the portable radio antenna.

* * * * *